US006360503B1

(12) United States Patent
Koenig, Jr.

(10) Patent No.: US 6,360,503 B1
(45) Date of Patent: Mar. 26, 2002

(54) DRYWALL-TRIMMING ACCESSORY HAVING BREAK-AWAY PANES

(75) Inventor: Joseph M. Koenig, Jr., Glenview, IL (US)

(73) Assignee: Trim-Tex, Inc., Lincolnwood, IL (US)

( * ) Notice: Subject to any disclaimer, the term of this patent is extended or adjusted under 35 U.S.C. 154(b) by 0 days.

(21) Appl. No.: 09/750,431

(22) Filed: Dec. 28, 2000

(51) Int. Cl.[7] ..... E04B 2/00

(52) U.S. Cl. ..... 52/287.1; 52/98; 52/288.1; 52/255

(58) Field of Search ..... 52/98, 100, 287.1, 52/288.1, 255, 256, 257

(56) References Cited

U.S. PATENT DOCUMENTS

| | | | | | |
|---|---|---|---|---|---|
| 3,201,908 | A | * | 8/1965 | Arnold | 52/255 |
| 3,323,264 | A | * | 6/1967 | Cross | 52/281 |
| 3,845,879 | A | * | 11/1974 | Dernbach et al. | 220/89.2 |
| 4,876,837 | A | * | 10/1989 | Kelly et al. | 52/287.1 |
| 5,138,810 | A | * | 8/1992 | Kartler | 52/254 |
| 5,778,617 | A | * | 7/1998 | Free | 52/255 |
| 6,070,374 | A | * | 6/2000 | Bifano et al. | 52/86 |
| 6,145,259 | A | * | 11/2000 | Koenig, Jr. et al. | 52/287.1 |

FOREIGN PATENT DOCUMENTS

| | | | | |
|---|---|---|---|---|
| JP | 420161063 | * | 6/1990 | 52/287.1 |

OTHER PUBLICATIONS

Catalog 2000T of Trim–Tex, Inc., Lincolnwood, Illinois—published 2000—see pp. 29 and 31.

* cited by examiner

*Primary Examiner*—Carl D. Friedman
*Assistant Examiner*—Brian E. Glessner
(74) *Attorney, Agent, or Firm*—Rockey, Milnamow & Katz, Ltd.

(57) ABSTRACT

In a drywall-trimming accessory molded from a polymeric material, such as polystyrene, and having two flanges, which diverge from each other, each flange is adapted in an intended use to cover an edge portion of a drywall panel and to have a fastener driven through said flange. Each flange has a mosaic of break-away panes. Each pane being adapted to break away from the flange having such pane, along at least one of the grooves defining such pane, if such pane is struck by a fastener being driven through the flange having such pane. Preferably, each pane is defined by two elongate, parallel apertures and by two elongate, parallel grooves, which are formed in an inner surface of the flange having such pane.

19 Claims, 2 Drawing Sheets

FIG. 1
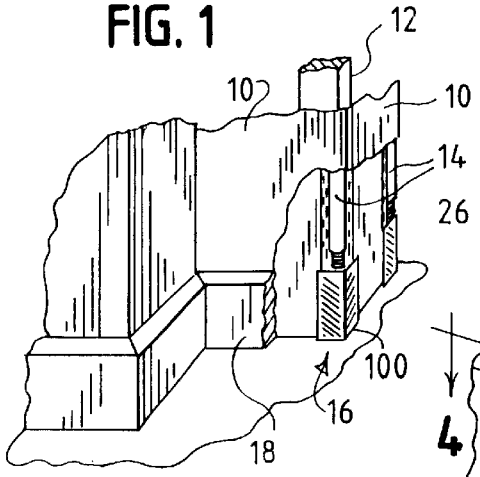
FIG. 3
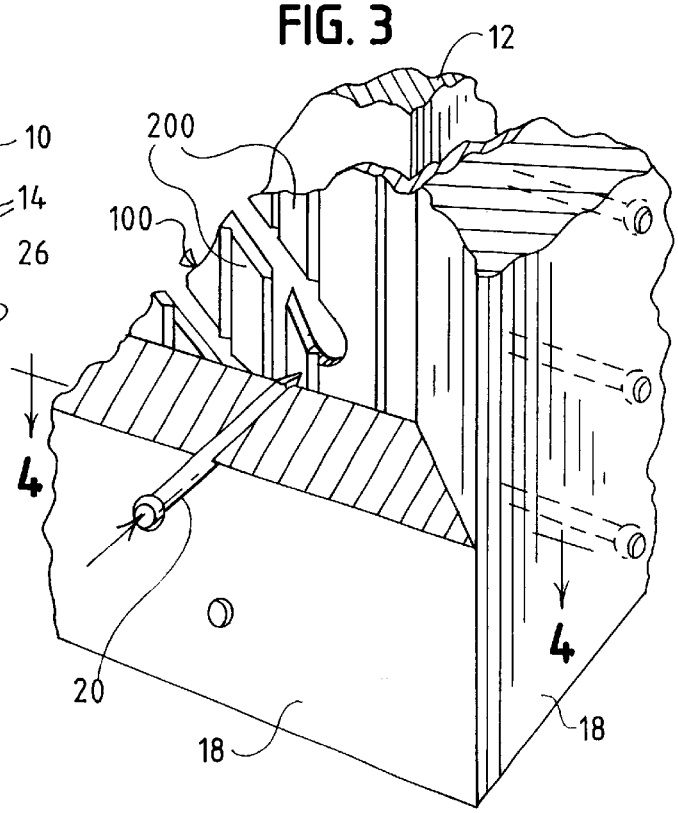
FIG. 2
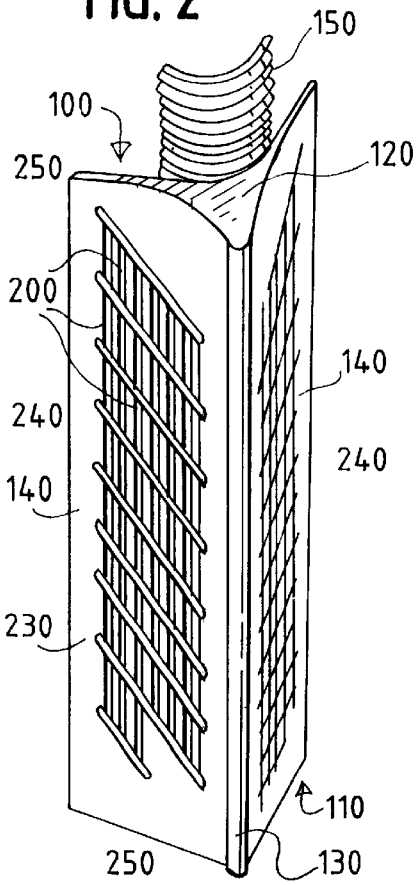
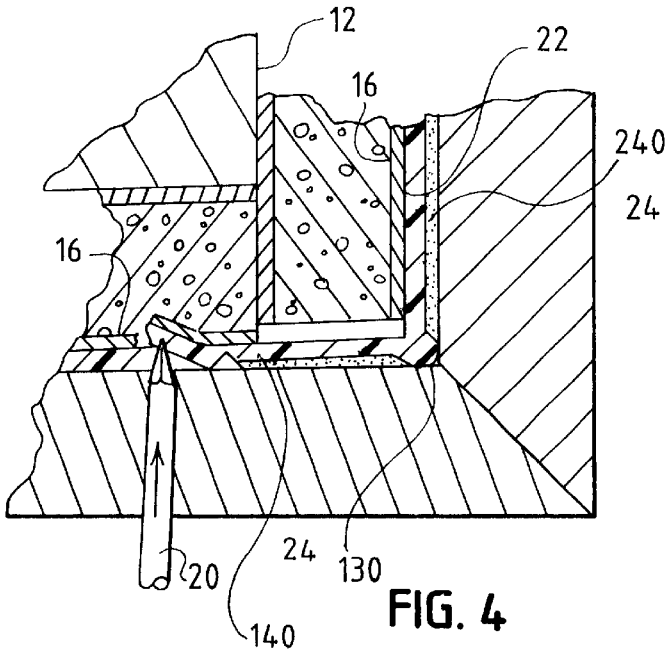
FIG. 4

FIG. 5
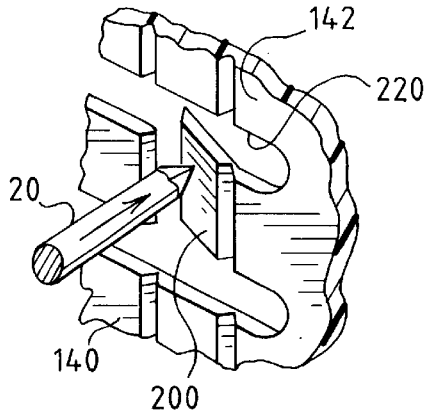
FIG. 6
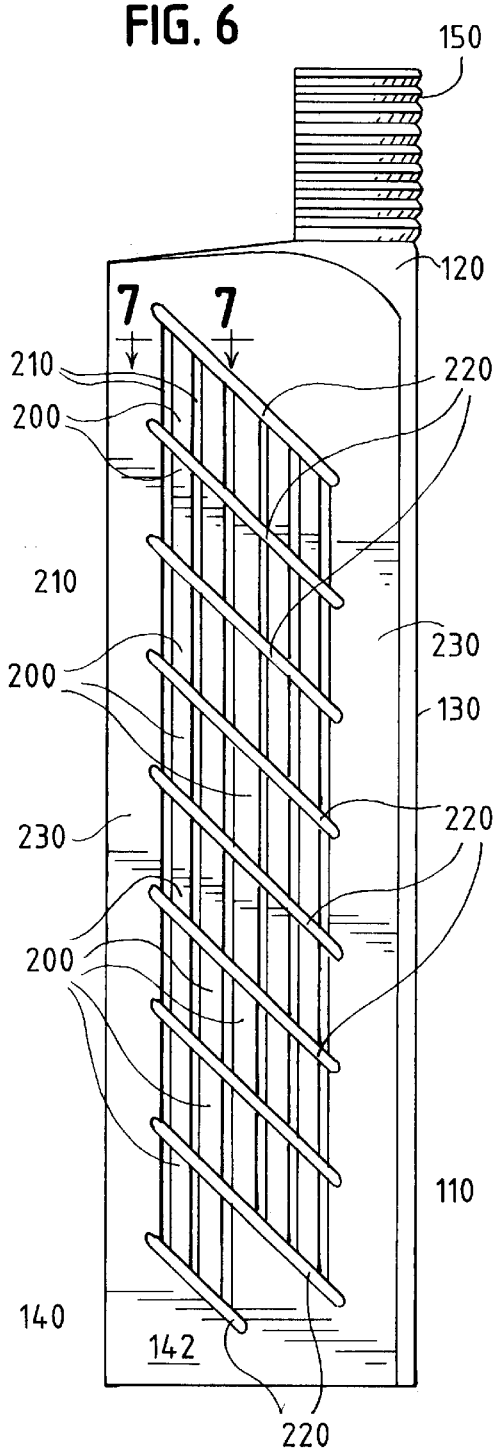
FIG. 7
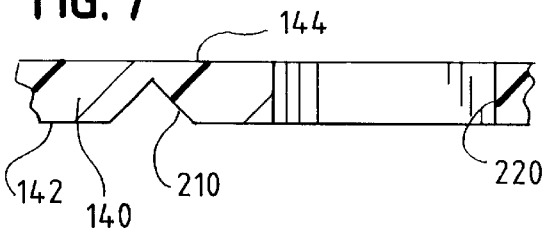
FIG. 8
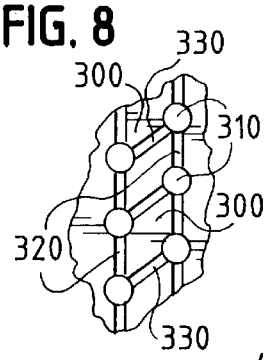
FIG. 9
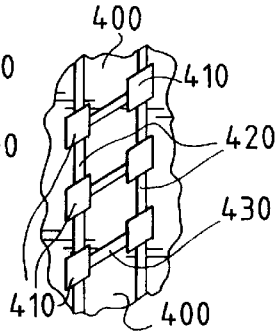
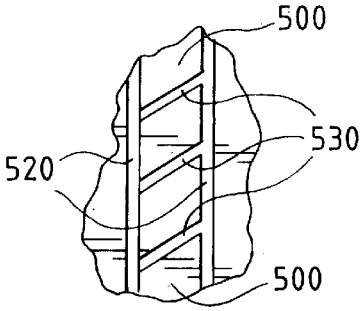
FIG. 10

DRYWALL-TRIMMING ACCESSORY HAVING BREAK-AWAY PANES

FIELD OF THE INVENTION

This invention pertains to a drywall-trimming accessory, which is adapted in an intended use to cover a portion of a drywall panel and to have a fastener driven through the drywall-trimming accessory. As improved by this invention, the drywall-trimming accessory has a mosaic of break-away panes.

BACKGROUND OF THE INVENTION

Commonly, in an installation of two drywall panels mounted to a wooden stud at a vertical corner, a drywall-trimming accessory, which is known as an adapter and which has two flanges and a transitional portion adjoining the flanges at their upper or lower ends, is used to define a transition between a so-called "bullnose" corner bead, which has a central portion defining a so-called "bullnose" corner (which in current trade parlance is a corner having a nominal radius not less than about 0.350 inch) and which has two flanges, and a nominally square base.

Over the nominally square base, which is defined by the flanges of the adapter, wooden baseboards, crown moldings, or other wooden or polymeric moldings are mounted via nails or other fasteners driven through the moldings, through the flanges of the adapter, through the drywall panels, into the wooden stud. When used with baseboards or floor moldings, the adapter is oriented so that the transitional portion adjoins the flanges at their upper ends. When used with crown moldings, the adapter is inverted so that the transitional portion adjoins the flanges at their lower ends. Being molded from polystyrene, such adapters, as known heretofore, are available commercially from Trim-Tex, Inc. of Lincolnwood, Illinois, and are illustrated in Catalog 2000T of Trim-Tex, Inc., on pages 29 and 31.

Usually, the flanges of the corner bead and the flanges of the adapter are covered by a drywall-finishing material (which installers tend to call "mud") so as to define what is known as a butt seam between the corner bead and the adapter, before the moldings are mounted. Commonly, the covered flanges and the drywall panels, where exposed, are painted before the moldings are mounted.

Undesirably, cracking of the drywall-finishing material, the paint, or both can occur under when fasteners, such as nails, are driven through a drywall-trimming accessory. Whether cracking occurs is believed to depend on such factors as what types of fasteners are used, what manual or powered tools are used to drive the fasteners, what force is used to drive the fasteners, and at what speeds the fasteners are driven.

Herein, a conventional drywall-trimming bead or a so-called "bullnose" drywall-trimming bead, as described above, is regarded as a drywall-trimming accessory. Further, an adapter, as described above, is regarded as a drywall-trimming accessory. Commonly, drywall-trimming beads are extruded from polyvinyl chloride and adapters are molded from polystyrene.

SUMMARY OF THE INVENTION

Broadly, this invention provides in a drywall-trimming accessory made from a polymeric material, such as polystyrene or polyvinyl chloride, and adapted in an intended use to cover an edge portion of a drywall panel and to have a fastener driven through said accessory, that said accessory has a mosaic of break-away panes. Each pane is adapted to break away from said accessory if said pane is struck by a fastener being driven through said accessory.

This invention may be advantageously embodied in a drywall-trimming accessory made from a polymeric material, such as polystyrene or polyvinyl chloride, wherein said accessory has a flange, which has an outer surface and an inner surface and which is adapted in an intended use to cover an edge portion of a drywall panel with the inner surface near the edge portion of the drywall panel and to have a fastener driven through the flange. As contemplated by this invention, the flange has the mosaic of break-away panes.

The panes are defined by grooves formed in at least one of the inner and outer surfaces, or by apertures extending through the flange and by grooves formed in at least one of the outer and inner surfaces, preferably by two said apertures, which are elongate and which are parallel, and by two said grooves, which are formed in the outer surface and which are parallel. Each pane is adapted to break away from the flange, along at least one of the grooves defining said pane, if said pane is struck by a fastener being driven through the flange.

In a preferred embodiment of this invention, the flange is one of two flanges, which diverge from each other, each flange having such a mosaic of break-away flanges. Although this invention is intended to be advantageously embodied in an adapter, as described above, this invention also can be advantageously embodied in a drywall-trimming accessory of another type, such as a conventional corner bead or an so-called "bullnose" corner bead.

BRIEF DESCRIPTION OF THE DRAWINGS

FIG. 1 is a fragmentary, perspective view showing an installation of a drywall-trimming accessory embodying this invention, together with a so-called "bullnose" corner bead, at a partially finished, exterior corner defined by two drywall panels. FIG. 2 also shows a fully finished, exterior corner.

FIG. 2, on an enlarged scale, is a perspective view of a drywall-trimming accessory similar to the drywall-trimming accessory shown in FIG. 1. The drywall-trimming accessory shown in FIG. 2 constitutes a preferred embodiment of this invention.

FIG. 3, on a similar scale is a fragmentary, perspective view showing a fastener being driven through a wooden molding, through a drywall-trimming accessory similar to the drywall-trimming accessories shown in FIG. 1, into a drywall panel (not shown) behind the drywall-trimming accessory that is shown.

FIG. 4 is a fragmentary, sectional view taken along line 4—4 in FIG. 3, in a direction indicated by arrows. FIG. 4 also shows two drywall panels, which include the drywall panel behind the drywall-trimming accessory that is shown.

FIG. 5 is a fragmentary, perspective detail of what is shown in FIGS. 3 and 4.

FIG. 6, on a further enlarged scale, is an elevational view of the drywall-trimming accessory shown in FIG. 2.

FIG. 7, on an even further enlarged scale, is a fragmentary, sectional view taken along line 7—7 in FIG. 6, in a direction indicated by arrows.

FIGS. 8, 9, and 10 are fragmentary details, each showing an alternative embodiment of this invention.

DETAILED DESCRIPTION OF THE ILLUSTRATED EMBODIMENTS

As shown in FIGS. 1, 3, 4, and 5, in an installation of two drywall panels 10 mounted to a wooden stud 12 at a vertical, exterior corner in a room, an adapter 100, which is a drywall-trimming accessory, is used to define a transition between a so-called "bullnose" corner bead 14 and a nominally square base 16, over which wooden baseboards 18 are mounted, via nails 20 driven through the baseboards 18, through the adapter 100, through the drywall panels 10, into the wooden stud 12. Rather than nails 20, other fasteners may be alternatively used, such as screws or staples.

As shown in FIGS. 2, 4, 5, 6, and 7, the adapter 100 is molded from a polymeric material, such as polystyrene, so as to have a lower portion 110 and an upper portion 120. The lower portion 110 has a rounded edge 130, which is solid in cross-section. Also, the lower portion 110 has two lateral flanges 140, which project from the rounded edge 130 at right angles to each other. The upper portion 120 has a projecting tab 150, which has an arcuate cross-section adapted to fit behind a central, arcuate portion of the corner bead 14, and is configured so as to define a transition 160 between the lateral flanges 140 and the projecting tab 150. Essentially, the projecting tab 150 conforms to the projecting tab disclosed in U.S. Patent No. 6,145,259, the disclosure of which is incorporated herein by reference.

Each lateral flange 140, which has an outer surface 142 and an inner surface 144, has a mosaic of break-away panes 200, each of which is defined by two elongate, parallel grooves 210 formed in the outer surface 142 and by two elongate, parallel apertures 220 extending through said lateral flange 140. Each pane 200 is adapted to break away, along one or more of the grooves 210 defining said pane 200 so as to be partially detached from the lateral flange 140 having said pane 200, as shown in FIG. 4 and FIG. 5, or so as to be completely detached from the lateral flange 140 having said pane 200, if said pane 200 is struck by a nail 20 being driven through the lateral flange 140 having said pane 200.

As shown, the panes 200 are not coextensive with said lateral flange 140 but are spaced by a wide margin 230 from the parallel, comparatively long edges 240 of said lateral flange 140 and from the parallel, comparatively short edges 250 of said lateral flange. 140. The wide margin 230 resists tendencies said lateral flange 140 to split, except as and where the panes 200 break away, when struck by a nail 20 being driven through said lateral flange 140.

Ordinarily, as shown in FIG. 4, before the baseboards 18 are mounted, an adhesive 22 is used with or without staples or other fasteners (not shown) to mount the adapter to the drywall panels 10, in a known manner. Ordinarily, as shown in FIG. 4, a drywall-finishing material 24 is applied over the lateral flanges 140 and is pressed firmly through the apertures 220, against the drywall panels 10, in a known manner. Ordinarily, the drywall panels 10 have outer paper layers 16, to which the drywall-finishing material 24 bonds in a known manner. The nails 20 are driven through the drywall-finishing material 24 when the nails 20 are driven through the baseboards 18, through the adapter 100, through the drywall panels 10, into the wooden stud 12. Ordinarily, where exposed, the drywall panels 10 and the drywall-finishing material 24 are painted before the baseboards 18 are mounted.

Presently, it is believed that, as said pane 200 breaks away, energy imparted by the nail 20 striking said pane 200 is dissipated, so as to reduce, minimize, or eliminate tendencies for cracking of the drywall-finishing material 24, the paint, or both to occur at a butt seam 26 (see FIG. 1) between the corner bead 14 and the adapter 100.

As shown in FIG. 7 and other views, each pane 200 is quadrilateral but not rectangular, the grooves 210 meeting the apertures 220 non-perpendicularly. In alternative embodiments, which are not shown, each pane may be triangular, rectangular, trapezoidal, hexagonal, otherwise polygonal, or non-polygonal, and different panes may have different configurations.

As shown in FIG. 7 and mentioned above, the grooves 210 defining each pane 200 are formed in the outer surface 142 of the lateral flange 140 having said pane 200. In an alternative embodiment (not shown) the grooves defining each pane are formed in the inner surface of the lateral flange having said pane.

In an alternative embodiment shown in FIG. 8, the panes 300 are similar to the panes 200, except that each pane 300 is defined by circular apertures 310, by longitudinal, parallel grooves 320, each connecting two apertures 310, and by transverse, parallel grooves 330, each connecting two apertures 310. The respective grooves 320, 330, are not perpendicular to one another.

In an alternative embodiment shown in FIG. 9, the panes 400 are similar to the panes 200, except that each pane 400 is defined by rhomboid apertures 410, by longitudinal, parallel grooves 420, each connecting two apertures 410, and by transverse, parallel grooves 430, each connecting two apertures 410.

In an alternative embodiment shown in FIG. 10, the panes 500 are similar to the panes 200, except that each pane 500 is defined (without apertures) by longitudinal, parallel grooves 520 and by transverse, parallel grooves 530.

What is claimed is:

1. A drywall-trimming accessory molded from a polymeric material and having a flange, which has an outer surface and an inner surface, the flange being adapted in an intended use to cover an edge portion of a drywall panel with the inner surface nearer the edge portion of the drywall panel and to have a fastener driven through the flange, the flange having a mosaic of break-away panes, each pane being defined by grooves formed in at least one of the outer and inner surfaces, or by apertures extending through the flange and by grooves formed in at least one of the outer and inner surfaces, each pane being defined by precisely two said apertures, which are elongate, and by precisely two said grooves, which are elongate, each pane being adapted to break away from the flange, along at least one of the grooves defining said pane, if said pane is struck by a fastener being driven through the flange.

2. The drywall-trimming accessory of claim 1, wherein the apertures are parallel to one another and wherein the grooves are parallel to one another.

3. A drywall-trimming accessory molded from a polymeric material and having a flange, which has an outer surface and an inner surface, the flange being adapted in an intended use to cover an edge portion of a drywall panel with the inner surface nearer the edge portion of the drywall panel and to have a fastener driven through the flange, the flange having a mosaic of break-away panes, each pane being defined by apertures extending through the flange and by grooves formed in the outer surface, each pane being defined by precisely two said apertures, which are elongate, and by precisely two said grooves, which are elongate, each pane being adapted to break away from the flange, along at least one of the grooves defining said pane, if said pane is struck by a fastener being driven through the flange.

4. The drywall-trimming accessory of claim 3, wherein the apertures are parallel to one another and wherein the grooves are parallel to one another.

5. A drywall-trimming accessory molded from a polymeric material having two flanges, which diverge from each other and each of which has an outer surface and an inner surface, each flange being adapted in an intended use to cover an edge portion of a drywall panel with the inner surface nearer the edge portion of the drywall panel and to have a fastener driven through said flange, each flange having a mosaic of break-away panes, which are defined by grooves formed in at least one of the outer and inner surfaces, or by apertures extending through the flange and by grooves formed in at least one of the outer and inner surfaces, each pane being adapted to break away from the flange having said pane, along at least one of the grooves defining said pane, if said pane is struck by a fastener being driven through the flange having said pane.

6. The drywall-trimming accessory of claim 5, wherein each pane is defined by at least two said apertures and by at least two said grooves.

7. The drywall-trimming accessory of claim 6, wherein each pane is defined by precisely two said apertures, which are elongate, and by precisely two said grooves, which are elongate.

8. The drywall-trimming accessory of claim 7, wherein the apertures are parallel to one another and wherein the grooves are parallel to one another.

9. A drywall-trimming accessory molded from a polymeric material and having two flanges, which diverge from each other, and each of which has an outer surface and an inner surface, each flange being adapted in an intended use to cover an edge portion of a drywall panel with the inner surface nearer the edge portion of the drywall panel and to have a fastener driven through said flange, each flange having a mosaic of break-away panes, which are defined by apertures extending through the flange and by grooves formed in the outer surface, each pane being adapted to break away from the flange having said pane, along at least one of the grooves defining said pane, if said pane is struck by a fastener being driven through the flange having said pane.

10. The drywall-trimming accessory of claim 9, wherein each pane is defined by at least two said apertures and by at least two said grooves.

11. The drywall-trimming accessory of claim 9, wherein each pane is defined by precisely two said apertures, which are elongate, and by precisely two said grooves, which are elongate.

12. The drywall-trimming accessory of claim 11, wherein the apertures are parallel to one another and wherein the grooves are parallel to one another.

13. The drywall-trimming accessory of any one of claims 5 through 12, wherein each flange has a proximal end and a distal end and wherein the drywall-trimming accessory has a transitional portion adjoining the proximal ends of the flanges and terminating in a projecting tab.

14. The drywall-trimming accessory of claim 13, wherein the projecting tab has an arcuate cross section.

15. A drywall-trimming accessory molded from a polymeric material and adapted in an intended use to cover a portion of a drywall panel and to have a fastener driven through said accessory, said accessory having a mosaic of break-away panes, each pane being defined by grooves formed in at least one of the outer and inner surfaces, or by apertures extending through said accessory flange and by grooves formed in at least one of the outer and inner surfaces, each pane being defined by precisely two said apertures, which are elongate, and by precisely two said grooves, which are elongate, each pane being adapted to break away from said accessory, along at least one of the grooves defining said pane, if said pane is struck by a fastener being driven through said accessory.

16. The drywall-trimming accessory of claim 15, wherein the apertures are parallel to one another and wherein the grooves are parallel to one another.

17. A drywall-trimming accessory molded from a polymeric material and adapted in an intended use to cover a portion of a drywall panel and to have a fastener driven through said accessory, said accessory having a mosaic of break-away panes adjacent to one another, each pane defining a polygon, which has only straight sides and which has not more than four sides, each pane being adapted to break away from said accessory if struck by a fastener being driven through said accessory.

18. The drywall-trimming accessory of claim 17, wherein each pane has precisely four sides.

19. The drywall-trimming accessory of claim 17, wherein each pane has precisely two sides defined by apertures through said accessory and precisely two sides defined by grooves in said accessory.

* * * * *